US005225164A

United States Patent [19]

Astle

[11] Patent Number: 5,225,164

[45] Date of Patent: Jul. 6, 1993

[54] MICROPLATE LABORATORY TRAY WITH RECTILINEAR WELLS

[76] Inventor: Thomas W. Astle, 607 Harborview Rd., Orange, Conn. 06477

[21] Appl. No.: 769,091

[22] Filed: Sep. 30, 1991

[51] Int. Cl.[5] ..... B01L 3/00

[52] U.S. Cl. ..... 422/102; 356/246; 356/440; 435/284; 435/301

[58] Field of Search ..... 422/102; 356/246, 440; 435/284, 301

[56] References Cited

U.S. PATENT DOCUMENTS

| | | | |
|---|---|---|---|
| Re. 30,562 | 3/1981 | Park | 435/310 X |
| 4,090,920 | 5/1978 | Studer, Jr. | 435/287 X |
| 4,167,875 | 9/1979 | Meakin | 422/101 X |
| 4,299,920 | 11/1981 | Peters | 435/285 |
| 4,498,782 | 2/1985 | Proctor et al. | 356/440 X |

FOREIGN PATENT DOCUMENTS

| | | | |
|---|---|---|---|
| 2435317 | 2/1976 | Fed. Rep. of Germany | 356/246 |
| 2819820 | 11/1978 | Fed. Rep. of Germany | 356/246 |

OTHER PUBLICATIONS

Dynatech brochure, date unknown, but predates invention.

Corning brochure, date unknown, but predates invention.

Greiner brochure, date unknown, but predates invention.

Nunc brochure, date unknown, but predates invention.

Beckman brochure date unknown, but predates invention.

*Primary Examiner*—Jill A. Johnston

*Attorney, Agent, or Firm*—John H. Crozier

[57] ABSTRACT

In a preferred embodiment, a microplate laboratory tray including a frame with a plurality of open top wells disposed in the frame, each of the wells having a bottom attached to four orthogonally joined generally vertical walls, and each pair of adjacent wells being separated by a single common wall. To promote mixing and oxygen transfer, one or more baffles may be disposed on one or more walls.

6 Claims, 2 Drawing Sheets

MICROPLATE LABORATORY TRAY WITH RECTILINEAR WELLS

BACKGROUND OF THE INVENTION

1. Background Art

The present invention relates to bioassay trays used in laboratories generally and, more particularly, to a novel bioassay tray, or microplate, having rectilinear wells.

2. Background Art

As the sensitivity of the testing protocols for biotechnological and medical research fields has been increased, the volume of reagents and samples has been reduced to microliter quantities. Today, the de facto standard for such fields is a 96-well thermoplastic tray having an array of small wells. The wells, holding up to 300 microliters per well, are conventionally arranged in an 8×12 matrix on 9-mm centers.

Originally, the wells were drilled holes in an acrylic block. Later, microplate trays were thermoformed. Now, such plates are injection molded. A common characteristic of all these trays, including those produced by some hundreds of manufacturers thereof world wide is that the wells are round. The bottoms of the wells may be flat, U-shaped, or V-shaped, but the upper portions of all are round.

There are a number of disadvantages to round wells. One is the relatively small volume compared to the available volume of a tray. This means that the volume of media is correspondingly small and the organisms can exhaust their food supply before adequate production byproducts are developed. Conventional round wells on a standard layout cannot simply be made deeper to increase volume, since tray handling and liquid transfer machinery has been built around a de facto height standard. Furthermore, making the wells deeper would decrease the surface area-to-volume ratio, thus decreasing the rate of oxygen transfer to the liquid in the wells.

A further disadvantage of round wells is that, when the contents of the wells are agitated with a reciprocating or oscillatory shaker to promote oxygen transfer to the liquid therein, the cylindrical walls of the wells tend to swirl the media around the inner wall with a minimum of agitation and oxygen transfer.

Another disadvantage of such wells it that there are air gaps between the wells which act as insulators to inhibit heat transfer between wells. Temperature is one of the primary controlling parameters in fermentation processes and it is important that all wells be at the same temperature. This is particularly critical with small volumes. With the insulating air gaps between wells, there can exist a wide temperature gradient between wells, particularly with a change in ambient temperature. For example, when the plate is first put into an incubator, there will be a large temperature gradient between the outer wells and the inner wells which gradient decreases only slowly because of the insulating air gaps.

Accordingly, it is a principal object of the present invention to provide a microplate laboratory tray having a conventional well layout but having increased well volume.

It is a further object of the invention to provide such a tray which allows improved agitation of the contents of the wells.

It is an additional object of the invention to provide such a tray having improved heat transfer between the wells.

It is another object of the invention to provide such a tray that can be used with conventional tray handling and liquid transfer machinery.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a microplate laboratory tray including a frame with a plurality of open top wells disposed in the frame, each of the wells having a bottom attached to four orthogonally joined generally vertical walls, and each pair of adjacent wells being separated by a single common wall. To promote mixing and oxygen transfer, one or more baffles may be disposed on one or more walls.

BRIEF DESCRIPTION OF THE DRAWING

Understanding of the present invention and the various aspects thereof will be facilitated by reference to the accompanying drawing figures, submitted for purposes of illustration only and not intended to define the scope of the present invention, in which.

DETAILED DESCRIPTION OF THE PREFERRED EMBODIMENTS

Figure 1:
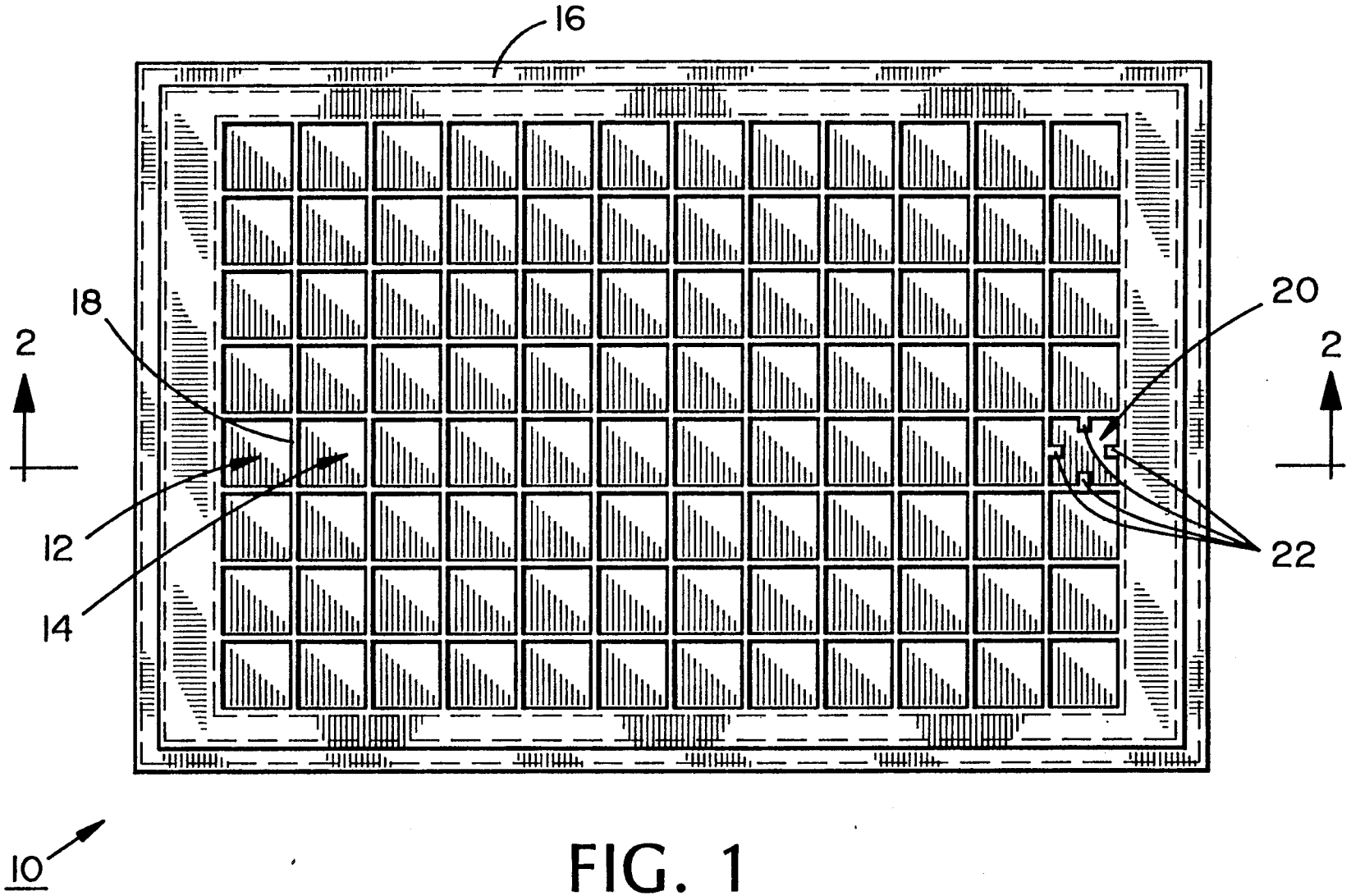
FIG. 1 is a top plan view of a microplate laboratory tray according to the present invention.
Figure 2:
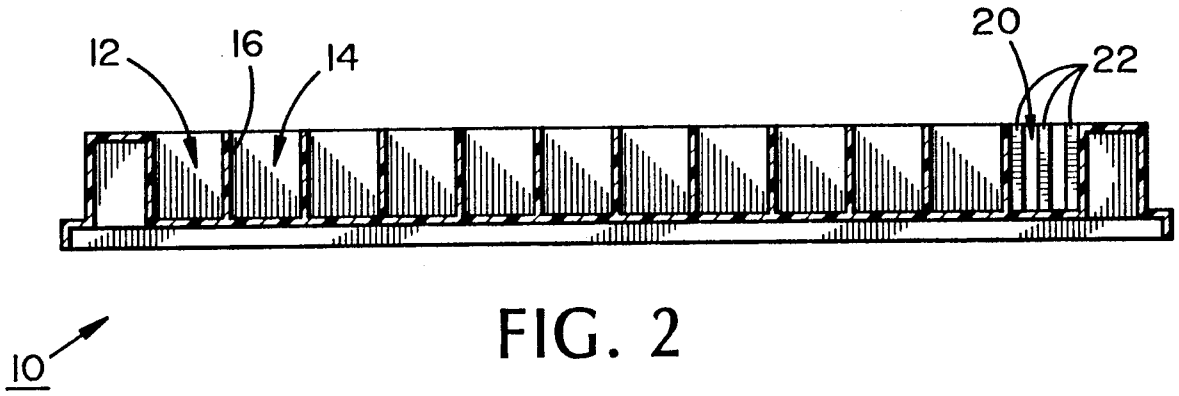
FIG. 2 is a side elevational view taken along the line "2—2" of FIG. 1.

Referring now to the Drawing, in which similar or identical elements are given consistent identifying numerals throughout the various figures thereof, there is depicted a microplate laboratory tray constructed according to the present invention, generally indicated by the reference numeral 10.

Tray 10 includes a plurality of open top wells, such as adjacent wells 12 and 14, laid out in a conventional 8×12 matrix in a frame 16 and it may be assumed that the wells have a conventional 9-mm center-to-center spacing. It can be seen that wells 12 and 14, as well as the other wells on tray 10, are rectilinear and, in plan view (FIG. 1), are square. The height of tray 10 is approximately the same as trays having conventional round wells and, therefore, tray 10 can be accommodated by conventional tray handling and liquid transfer machinery.

Wells 12 and 14 are separated by a relatively thin common wall 18 and it can be seen that all adjacent wells are likewise separated by similar common walls. Although wells 12 and 14 have flat bottom wells, the wells could be provided with other bottom shapes, such as round, V-shape, or U-shape bottoms.

It can be seen that the entire usable volume of tray 10 is occupied by wells and, in fact, wells 12 and 14 have a volume about twice that of conventional round wells. Since this increase has been obtained without increasing the depth of the wells, the surface area of the wells has also doubled, with a concomitant increase in oxygen transfer capability.

With wells 12 and 14 having square corners, when tray 10 is placed in a reciprocating or oscillatory shaker for agitation, the square corners will help transmit mixing energy to the liquid in the cells and tend to prevent swirling of the liquid against the walls of the cells. Thus, rate of oxygen transfer to the liquid is increased over that attainable with conventional round wells.

It can be seen that, since each well of tray 10 is separated from its neighbor(s) by a single common wall(s), such as wall 18 between wells 12 and 14, there is no air gap therebetween and the rate of heat transfer between adjacent wells is solely by conduction rather than an inefficient combination of conduction and convection as is the case with conventional round wells.

To further promote mixing and increase the rate of oxygen transfer to the liquid in the wells of tray 10, one or more internal baffles, such as baffles 22 in well 20 may be provided. Baffles 22 may be in the form of straight fins, as shown, or they may have a triangular or other shape.

Figure 3:
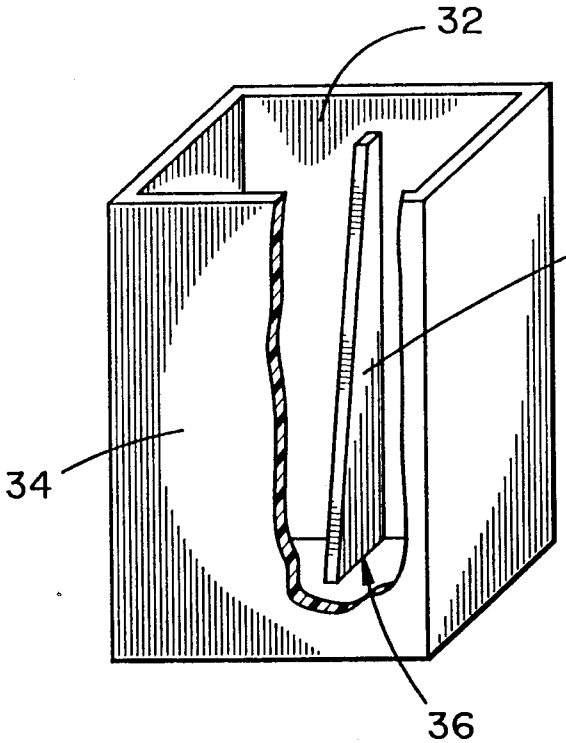
FIG. 3 is an enlarged perspective view, partially cut-away, of a microplate well with a triangular baffle fin therein.

A triangular shaped baffle fin 30 is shown on FIG. 3 where it is vertically disposed against a wall 32 of a microplate well 34. It can be seen that the base 36 of baffle fin 30 extends across approximately one/half the bottom of well 34. This arrangement assists in moving solid materials from the lower part of well 34 as the contents of the well are agitated.

The elements of tray 10 may be economically and easily constructed as a unitary molded polystyrene form.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A microplate laboratory tray, comprising:

(a) a frame;

(b) a plurality of open top wells disposed in said frame, each of said wells having a bottom attached to four orthogonally joined generally vertical walls;

(c) each pair of adjacent said wells being separated by a single common wall; and (d) at least one vertical mixing baffle disposed against at least one said wall of a said well to promote mixing and increase rate of oxygen transfer.

2. A microplate laboratory tray, as defined in claim 1, wherein said wells are disposed in an eight-by-twelve pattern, with the centers of adjacent said wells spaced 9 millimeters apart.

3. A microplate laboratory tray, as defined in claim 1, wherein said walls are joined in a square pattern.

4. A microplate laboratory tray, as defined in claim 1, wherein said bottom is horizontal and flat.

5. A microplate laboratory tray, as defined in claim 1, wherein said at least one vertical mixing baffle has a triangular shape and the base thereof extends along the bottom of a said well approximately one-half the width of said bottom.

6. A microplate laboratory tray, as defined in claim 1, wherein said at least one vertical mixing baffle is rectangular and the width thereof extends into said well about one-quarter of the width of said well.

* * * * *